United States Patent [19]

Cohen

[11] 4,017,353

[45] Apr. 12, 1977

[54] ACCESSORY TOOL FOR BURGLAR ALARM FOIL

[76] Inventor: Morton Cohen, 41-27 Westmorland St., Little Neck, N.Y. 11363

[22] Filed: Feb. 9, 1976

[21] Appl. No.: 656,291

[52] U.S. Cl. ..... 156/574; 15/236 R; 156/579

[51] Int. Cl.[2] ..... B44C 7/00; A47L 13/02

[58] Field of Search ..... 156/574, 579; 15/236 R

[56] References Cited

UNITED STATES PATENTS

| | | | |
|---|---|---|---|
| 2,245,469 | 6/1941 | Ecklund et al. | 15/236 R |
| 2,280,778 | 4/1942 | Andersen | 15/236 R |
| 2,410,420 | 11/1946 | Bennett | 15/236 R |
| 2,817,863 | 12/1957 | Johns | 15/236 R |
| 2,822,563 | 2/1958 | Kump et al. | 15/236 R |
| 3,789,450 | 2/1974 | Mozdenski et al. | 15/236 R |
| 3,829,347 | 8/1974 | Honea | 156/579 |
| 3,929,345 | 12/1975 | Nasby | 15/236 R |

*Primary Examiner*—Douglas J. Drummond
*Attorney, Agent, or Firm*—Bauer, Amer & King

[57] ABSTRACT

In the adhesive attachment of foil of a burglar alarm system in a rectangular or other shaped pattern along the periphery of a storefront window, a tool for facilitating the making of corners or crossovers in the foil which tool, positioned over the foil folded back on itself at said crossover, includes an angularly oriented changing-direction edge over which the foil is again folded upon itself with two significant results. First, the foil adhesive surface is again faced toward the window preparatory to adhesive contact therewith. Second, the remaining foil length is properly oriented in the contemplated changed direction completing the crossover.

6 Claims, 7 Drawing Figures

ACCESSORY TOOL FOR BURGLAR ALARM FOIL

The present invention relates generally to procedures for handling self-adhesive burglar alarm foil, and more particularly to a convenience tool or accessory for facilitating the making of crossovers during the adhesive attachment of the foil in its required pattern on the window or like support surface of the premises being supervised by the burglar alarm system.

As generally understood, turning a corner with burglar alarm foil must be achieved in a neat, flat crossover, otherwise inadvertent brushing contact against the foil could tear it away, or otherwise cause damage to it which might adversely affect the operation of the alarm system. To produce such a crossover, in turn requires folding manipulation of the foil in a sequence somewhat complicated by the need to change directions while avoiding inadvertent contact of different areas of the foil adhesive surface with each other. It is undoubtedly due to the foregoing that prior art installation of the foil is done entirely manually, and is therefore time-consuming and tedious.

Broadly, it is an object of the present invention to improve on the manual procedures of installing burglar alarm foil, and otherwise to overcome the foregoing and other shortcomings of the prior art. Specifically, it is an object to provide a simply constructed and easy-to-use accessory tool for facilitating the making of crossovers during adhesive attachment of the foil.

A convenience or accessory tool for the end use noted, which demonstrates objects and advantages of the present invention, includes a generally rectangular body having opposite foil-positioning and distal sides. A triangular cutout is formed in the foil-positioning side to create an aligning edge and an angularly oriented changing-direction edge. Use of the tool contemplates an operative position established by the alignment of the tool aligning edge with an edge of the foil adhesively attached in a first direction along the window, in which operative position the tool is in an advantageous superposed position over the foil which is in folded back relation on itself exposing its adhesive surface. The foil is then adapted to be folded again upon itself, but this time along the changing-direction edge of the tool both to orient the foil in a second transverse direction and to reestablish the facing relation of the foil adhesive surface to the window. The tool also includes a grip along its distal edge for the final step of removing the tool from beneath the foil adhesive surface, whereby there may be continued adhesive attachment of the foil to the window in the changed transverse direction.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein.

Figure 1:
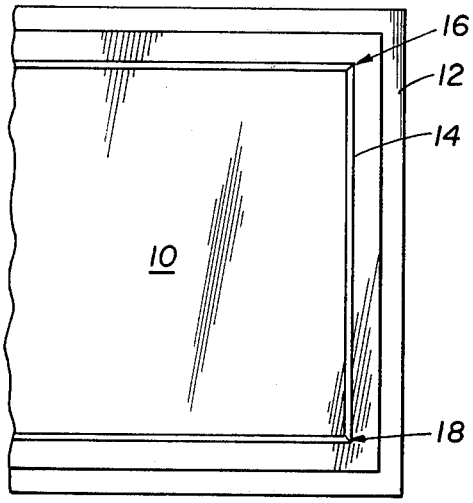
FIG. 1 is a partial front elevational view illustrating a typical installation of burglar alarm foil on a storefront window.

Reference is now made to the drawings, and in particular to FIG. 1 in which there is illustrated a typical storefront window 10 mounted in frame 12 and having electrically conductive foil 14 adhesively secured along the peripheral edge of window 10. As generally understood, foil 14 is part of a burglar alarm system in popular use by retailers which discourages unauthorized entry upon the premises by causing a sound or other type of alarm to be activated when window 10 is broken which, in turn, causes electrical discontinuity in the foil 14. The present invention relates to an accessory tool, generally designated 20, as more particularly illustrated in FIGS. 4–6, for facilitating the adhesive attachment of the foil 14 in its operative position on the window 10 as illustrated in FIG. 1.

As generally understood, the adhesive attachment of foil 14 to the window 10, while requiring some skill and technique, is not particularly difficult except when encountering crossovers of the foil, as illustrated in FIG. 1 by the reference numerals 16 and 18. As should be obvious, the difficulty in effectuating the crossover is of course occasioned by the foil having to undergo a 90 degree change in its direction.

Figure 2:
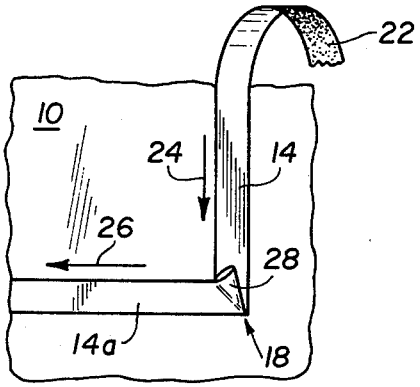
FIG. 2 illustrates a crossover of the foil, i.e. change of direction, which is to be avoided.

For purposes of illustration, reference should be made to FIG. 2, which depicts what should be avoided in a crossover. More particularly, foil 14, which will be understood to be of the self-adhesive type, and therefore has an adhesive coating 22 on its undersurface, is shown in FIG. 2 to be oriented in a first direction 24. At the crossover, for description purposes assumed to be similar to that designated 18 in FIG. 1, the contemplated second direction 26 requires a 90° angular change. This 90° change is improperly accomplished by forming the foil into triangular segments, designated 28, and allowing the adhesive 22 coextensive with these segments 28 to make adhesive contact with each other. As illustrated in FIG. 2, this properly orients the length segment **14*a* of the foil in the direction 26, but it also disadvantageously results in an upstanding projection of the triangular segments 28 at crossover 18. As a consequence, in normal use, it is likely that the foil segments 28 will be torn away by inadvertent contact, thereby adversely affecting the operation of the burglar alarm system. In any event, the upstanding segments 28** are unsightly and commercially undesirable.

Figure 3A:
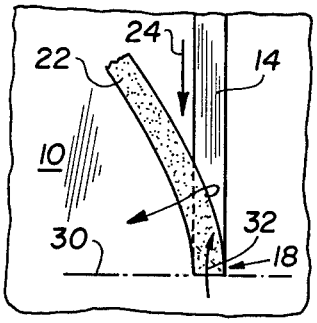
FIGS. 3A and 3B illustrate, in sequence, the manner of properly effectuating a crossover of the foil.
Figure 3B:
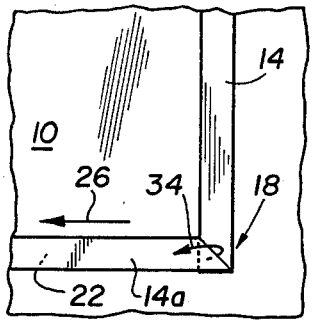

The proper manner of achieving the foil crossover, again taking crossover 18 as an example, is illustrated in FIGS. 3A and 3B. More particularly, the proper technique contemplates adhesively securing the foil 14 in said first direction 24 up to reference line 30 at which a change of direction is to be made providing the crossover 18. Next, foil 14 is folded back upon itself, as in the direction 32, which unavoidably exposes its adhesive surface 22. Stated another way, adhesive surface 22, as a result of the fold back 32, is at this time facing away from the window 10, and thus in the wrong direction for adhesive connection thereto.

However, as illustrated in FIG. 3B, foil 14 is again folded upon itself, as in the direction 34, which produces two significant results. First, it reestablishes the facing relation of the foil adhesive surface 22 to the window 10. Second, it properly orients the foil length segment 14*a* in the changed direction 26.

Figure 4:
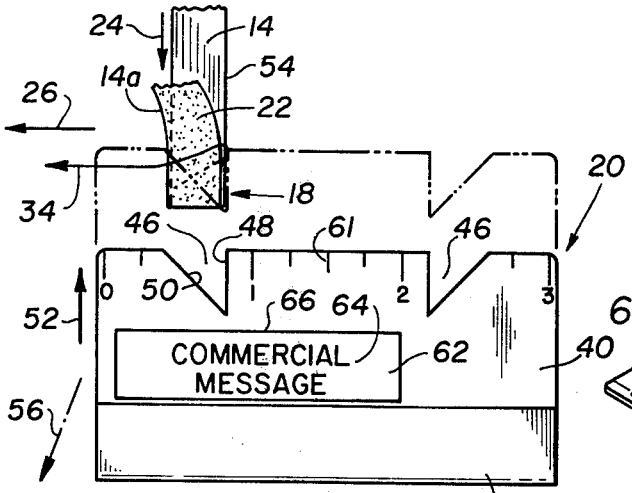
FIG. 4 is a front elevational view illustrating an accessory tool for facilitating making the crossover of the foil as illustrated in FIGS. 3A, 3B, the positions of movement of said accessory tool being illustrated in full line and phantom line perspective.
Figure 5:
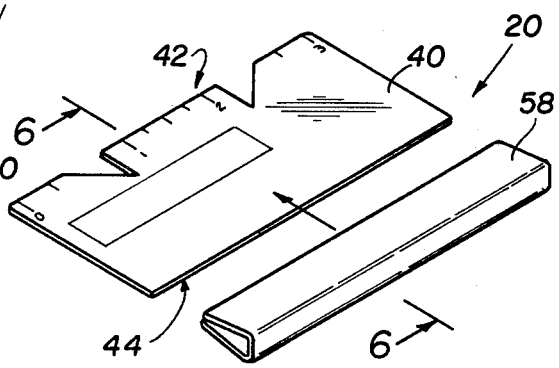
FIG. 5 is a perspective view showing further structural features of the accessory tool.
Figure 6:
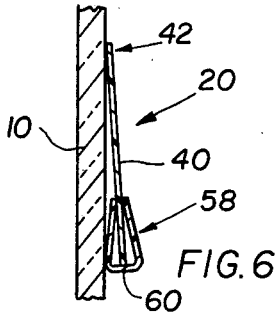
FIG. 6 is a side elevational view, in cross section on line 6—6 of FIG. 5, illustrating further structural details.

Reference should now be made to FIGS. 4–6, which illustrate the inventive accessory tool 20 hereof which facilitates making a crossover in the foil 14 in accordance with the proper manner and technique just described in connection with FIGS. 3A, 3B. Tool 20, in the preferred form hereof illustrated in FIGS. 4–6, includes a plastic planar body 40, of generally rectangular shape, having on opposite sides a foil-positioning side 42 and a remote or distal side 44. As clearly illustrated, provided in the foil-positioning side 42 are two triangular cutouts, each generally designated 46, identical to each other except 180 degrees out of phase. For brevity sake, only the lefthand cutout 46, as viewed in FIG. 4, will be described in detail. Said cutout 46 is bounded by an alignment edge 48 and by a changing-direction edge 50, the latter angularly oriented in the illustrated embodiment at a 45° angle. The 45° angular orientation of the edge 50 is required for a 90° change in direction, but other angular orientations of the edge 50 would be dictated by changes of direction in the foil 14 of angles other than 90°.

The manner of using tool 20 is as follows. Foil 14 is assumed to be in adhesively attached condition to the window 10 and extended in said first direction 24 up to the point where crossover 18 is contemplated. As already explained in connection with FIG. 3A, foil 14 is manipulated through a first foldback 32, exposing its adhesive surface 22. Tool 20 is, at this point, moved, as along the direction 52 into an operative position, as illustrated in phantom perspective in FIG. 4, in which it is placed over the foil adhesive surface 22. Assisting in establishing this operative position for the tool 20 is the aligning edge 48 of cutout 46 which is correspondingly aligned with the foil edge 54. In its FIG. 4 operative position, the changing-direction edge 50 is strategically located in superposed position and angularly across the foil adhesive surface 22. Foil 14 is then provided with its second folding movement 34, as already described in connection with FIG. 3B, but this time along said changing-direction edge 50. As a consequence of the folding movement 34, as already noted, this places the foil adhesive surface 22 in facing relation to the window 10 and also orients the foil length portion 14*a* in the changed transverse second direction 26.

In order to allow continued adhesive attachment of foil 14 in the new direction 26 it is merely necessary to withdraw tool 20 from beneath the foil adhesive surface 22. This is preferably done by easing tool 20 in the slightly angular direction 56, as illustrated in FIG. 4. To facilitate withdrawal movement 56 of tool 20 the plastic material of construction selected for the body 40 will have a low coefficient of friction, one such suitable plastic being polyvinyl chloride.

Withdrawal movement 56 of the tool 20 is also facilitated by the triangular grip construction 58 which is frictionally engaged along the distal edge 44. As best illustrated in FIG. 6, grip 58 includes a transversely oriented wall 60 which, in the operative position of the tool 20 on window 10 maintains the body 40 in a clearance position therefrom and thus limits contact thereof to line contact along the foil-positioning edge 42.

Tool 20 is shown in its preferred actual size in FIG. 4 from which it may be readily appreciated that it can readily accommodate a paper substrate or sticker 62 adhesively secured to the body 40. It is contemplated that sticker 62 will have imprinted thereon an appropriate commercial message 64 which, consistent with the low manufacturing cost of the accessory tool 20 enables it to be commercially used as an advertising giveaway. The sticker 62 also advantageously presents an upper edge 66 which cooperates with the aligning edge 48 in establishing the proper operative position of the tool 20 at a crossover. That is, edge 48 aligns, as already noted, with the foil edge 54, while the paper substrate upper edge 66 serves as a visual guide as to the path of the contemplated second direction 26 for the foil 14. Scale 61 provides a convenient measuring means.

From the foregoing description it should be readily appreciated that there has been described herein a handy, economically produced, tool for facilitating the making of crossovers in burglar alarm foil during its adhesive attachment to a storefront window 10 or similar support surface. While a preferred embodiment of the tool 20 has been described herein, however, a latitude of modification, change and substitution is intended, and in some instances some features of the invention will be employed without a corresponding use of other features. Accordingly, it is appropriate that the appended claims be construed broadly and in a manner consistent with the spirit and scope of the invention herein.

What is claimed is:

1. A tool for facilitating the adhesive attachment on a window or like support surface of self-adhesive burglar alarm foil in a crossover contemplating a 90° change of direction, said tool comprising a generally rectangular body having opposite foil-positioning and distal sides, a triangular cutout in said foil-positioning side presenting an aligning edge which is perpendicular to the foil-positioning side has been inserted, and an angularly oriented changing-direction edge both of which bound said triangular cutout, the angle between the aligning edge and the changing-direction edge is 45° said tool having an operative position established by the alignment of said tool aligning edge with an edge of said foil adhesively attached in a first direction along said window in which said tool is then in a superposed position over said foil in folded back relation on itself exposing said foil adhesive surface, said foil being adapted to be folded again upon itself but along said changing-direction edge of said tool both to orient said foil in a second transverse direction and to reestablish the facing relation of said foil adhesive surface to said window, and a grip along said distal edge for removing said tool from beneath said foil adhesive surface, whereby there may be continued adhesive attachment of said foil to said window in said changed transverse direction.

2. A convenience tool for burglar alarm foil as defined in claim 1, wherein said foil-positioning edge includes another triangular cutout, but in a 180° out of phase relation, to thereby facilitate achieving said foil crossover in corresponding 180° opposite directions.

3. A convenience tool for burglar alarm foil as defined in claim 2 wherein said grip is comprised of a triangular construction frictionally engaged along said distal edge and includes a wall oriented transverse to said body effective to hold said body in a clearance position from said window with only said foil-positioning side in line contact therewith, to thereby contribute to the ease of removal of said tool from beneath said foil adhesive surface.

4. A convenience tool for burglar alarm foil as defined in claim 3 wherein said body adjacent said foil-positioning edge is of a construction material having a low friction surface, to thereby further contribute to the ease of removal of said tool from beneath said foil adhesive surface.

5. A convenience tool for burglar alarm foil as defined in claim 4 wherein said body includes a reference marking oriented perpendicular to said aligning edge which cooperates therewith to establish said operative position of said tool at said foil crossover, said reference marking being parallel to said contemplated changed transverse direction of said foil.

6. A convenience tool for burglar alarm foil as defined in claim 5 wherein said size of said body between said foil-positioning and distal edges is of a sufficient extent for placement of a paper substrate thereon imprinted with a commercial message, and wherein the upper edge of said paper substrate effectively serves as said reference marking.

* * * * *

UNITED STATES PATENT OFFICE

CERTIFICATE OF CORRECTION

PATENT NO. : 4,017,353

DATED : April 12, 1977

INVENTOR(S) : MORTON COHEN

It is certified that error appears in the above-identified patent and that said Letters Patent are hereby corrected as shown below:

Column 4, line 40, after "side" delete --has been inserted--.

Signed and Sealed this

Fourteenth Day of June 1977

[SEAL]

*Attest:*

RUTH C. MASON
*Attesting Officer*

C. MARSHALL DANN
*Commissioner of Patents and Trademarks*